US006073103A

United States Patent [19]

Dunn et al.

[11] Patent Number: 6,073,103

[45] Date of Patent: Jun. 6, 2000

[54] DISPLAY ACCESSORY FOR A RECORD PLAYBACK SYSTEM

[75] Inventors: James M. Dunn, Ocean Ridge; Edith Helen Stern, Boca Raton, both of Fla.

[73] Assignee: International Business Machines Corporation, Armonk, N.Y.

[21] Appl. No.: 08/636,814

[22] Filed: Apr. 25, 1996

[51] Int. Cl.[7] ..... G10L 9/06

[52] U.S. Cl. ..... 704/276; 704/211; 704/275; 704/278

[58] Field of Search ..... 395/2.2, 2.84, 395/2.85, 2.87

[56] References Cited

U.S. PATENT DOCUMENTS

| | | | |
|---|---|---|---|
| 4,627,001 | 12/1986 | Stapleford et al. | 364/513.5 |
| 4,972,462 | 11/1990 | Shibata | 379/89 |
| 5,020,107 | 5/1991 | Rohani et al. | 381/43 |
| 5,036,539 | 7/1991 | Wrench, Jr. et al. | 381/43 |
| 5,136,655 | 8/1992 | Bronson | 381/41 |
| 5,199,077 | 3/1993 | Wilcox et al. | 381/43 |
| 5,220,611 | 6/1993 | Nakamura et al. | 381/48 |
| 5,381,466 | 1/1995 | Wilcox et al. | 381/43 |

*Primary Examiner*—Allen R. MacDonald
*Assistant Examiner*—Alphonso A. Collins
*Attorney, Agent, or Firm*—Richard A. Tomlin; Robert Lieber

[57] ABSTRACT

A record playback system includes a display showing elapsed time of a record playback operation together with symbols indicating occurrences of certain sequences of sound during the playback operation, the symbols positioned to indicate times at which respective sequences of sounds occur. In a preferred application, the records reproduced in the system are audible voice-mail messages, the specific sequences of sounds are numbers or sets of numbers spoken consecutively during the message, and the symbols representing such numbers are printed characters corresponding to respective numbers. In the preferred application, the messages are centrally recorded at a server of a computer network and distributed to individual client computers via the network. The tasks performed at the server include monitoring of elapsed recording time, detection of numbers spoken during each message as the recording is made, and recording of "displayable" symbols representing detected numbers in association with elapsed time at instants of their detection. The detection of spoken numbers is performed by software-based speaker-independent speech recognition. Thus, the messages retrieved at the client computers contain all the information needed to form the display of elapsed time and symbols indicating numbers spoken in each message.

16 Claims, 6 Drawing Sheets

Start
60
User accesses mailbox
61
Receives Display of message types and selection icons
b
(from Fig. 7B)
62
Selects Message
63
Message downloaded
64
Message audibly played out
Time chart with overlaid numbers displayed
(numbers appear when spoken at appropriate time positions in chart)
65
a
(to Fig. 7B)

DISPLAY ACCESSORY FOR A RECORD PLAYBACK SYSTEM

FIELD OF THE INVENTION

This invention relates to accessories for audio record playback systems, which facilitate understanding important parts of a recording. In a preferred embodiment, such accessories have particular application to voice-mail applications of multimedia computer systems, and are useful in such systems to provide a time scale showing elapsed time of playout of an audio message together with symbols indicating times at which words in a specific vocabulary of words are spoken.

BACKGROUND OF THE INVENTION

Presently known voice-mail systems provide time scales displaying elapsed time of playout of one or more messages. Such scale indications enable a user of the system to reposition a replay function, and replay a portion of a message without having to replay and listen to all of the same message.

Other known voice-mail systems use speech recognition to convert audible messages to displayed/printed text.

Furthermore, the present state of the speech recognition arts allows for detection of small vocabularies of words (or expressions) in a "speaker independent" manner (i.e. independent of speaker accents, inflections, etc.).

However, we are presently unaware of the existence of voice-mail (or other record) replay systems which provide both a time scale of elapsed message playout time and additional symbolic indications; the latter alerting a user of the system instantaneously to locations in a message wherein words (or other expressions) in a limited specific vocabulary of words/expressions (or, even more generally, sound sequences) are spoken (or uttered). Such additional indications, as presently contemplated, would enable a user to take actions directed specifically to these symbolic indications.

For instance, the user could instantaneously stop playout, when one of these additional indications appears on the time scale, and later permit playout to continue, in order to allow time for the user to grasp the contextual significance of a spoken word (or term or expression) represented by the respective additional indication. As another example, an additional indication could be used to enable the user to replay a small portion of a message, containing the term represented by the respective indication, without having to play more of the message than the user actually needs or wants to hear.

We believe that a facility of this kind would be quite useful, and have directed the present invention to such.

SUMMARY OF THE INVENTION

In a preferred embodiment, our invention comprises means for displaying a time scale representing elapsed time of playout of an audio message or recording, means for detecting when specific sequences of sound occur in the message or recording, and means responsive to detection of such sequences of sound for displaying symbols alongside of the time scale representing respective sound sequences.

The time scale may be displayed in any graphic format (line, bar, pie chart, or other). In applications wherein the message or recording comprises voice-mail type functions, the specific sequences of sounds may be those associated with a small number of words selected from the entire vocabulary of the language in which the messages are spoken; for example, words representing numbers. Furthermore, the detection of these words may be handled in a "speaker-independent" manner (without dependence on voice intensity, inflections, etc., of different speakers). By selecting a suitable vocabulary to be recognized, virtually all information needed by a user for determining the significance of a voice-mail message, and how to reply to it if a reply is warranted, can be quickly ascertained without requiring the user to listen to or replay more of a message than the user needs to or wants to hear.

For example, if the selected vocabulary consists of numbers spoken in a voice-mail message, the display of symbols representing the numbers at appropriate positions on the time scale would alert the user to take action, if desirable, for grasping the contextual significance of numbers which considered out of context could be ambiguous (e.g. have indefinite or indeterminate meanings). The action taken by the user could be to stop the message playout when the symbol for a number appears on the time scale, and then continue the playout listening carefully for the context; or it could be to reposition (rewind) to the time position of a number symbol and replay a small portion of the message containing the respective number.

Furthermore, when plural words in the selected vocabulary are uttered consecutively during replay (without other words spoken between them), this embodiment of our invention displays characters or symbols corresponding to all of the words in juxtaposition to a common location on the time scale, so that a user may view each such series of spoken words as a time-related set and quickly (and selectively) replay a small portion of a message including the series.

Considering that the voice recognition element of the invention could be costly to implement in hardware, it is contemplated that in a preferred embodiment essential elements of the invention—e.g., those required for speech recognition, generation of the display graph, control of record play ("rewind", "fast forward", "pause", "play", etc.) —would be distributed in a software form suitable for use on general purpose personal computers equipped for multimedia applications; where such distribution could be accomplished e.g. from a network server via a communication network, on computer readable media (disk, diskette, CD-ROM, etc.), etc. It is contemplated further that such software, when sent over a network, would be sent in a compressed form and accompanied by decompression software appropriate for loading the software into the user's system in a "ready to execute" state.

It is also contemplated that such software could be delivered in forms selected to be compatible with different operating system environments in computers owned by users of the foregoing network voice-mail application, and possibly even to be compatible with different hardware or system architecture environments of such computers; whereby the invention could be adapted to serve users having computers with different operating systems and different hardware or architecture constructions.

It is also contemplated that a simplified version of the invention could be implemented in a special purpose form—e.g. for use as part of a telephone answering device—wherein the symbol displayed for detected sounds would simply be an index mark suitably positioned on the time scale. Although the index mark would not identify a specific number or other sound sequence it would nonetheless alert the user to the position in time at which one of the sound sequences, in a small but important vocabulary of such, had been spoken and allow the user to act appropriately to grasp contextual significance.

These and other features, aspects, benefits and advantages of our invention may be more fully understood by considering the following drawings, detailed description and claims.

DETAILED DESCRIPTION

1. Prior Art

Figure 1:
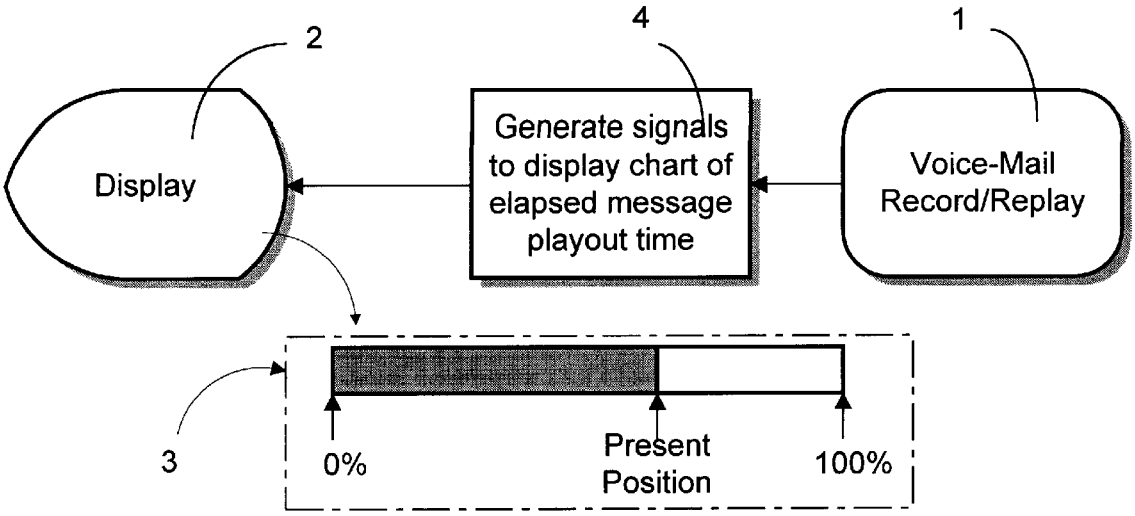
Figure 1 (Prior Art)
FIG. 1 is a block diagram schematically showing a prior art arrangement for displaying a varying scale representing time elapsed in playout of one or more voice-mail messages.
Figure 2:
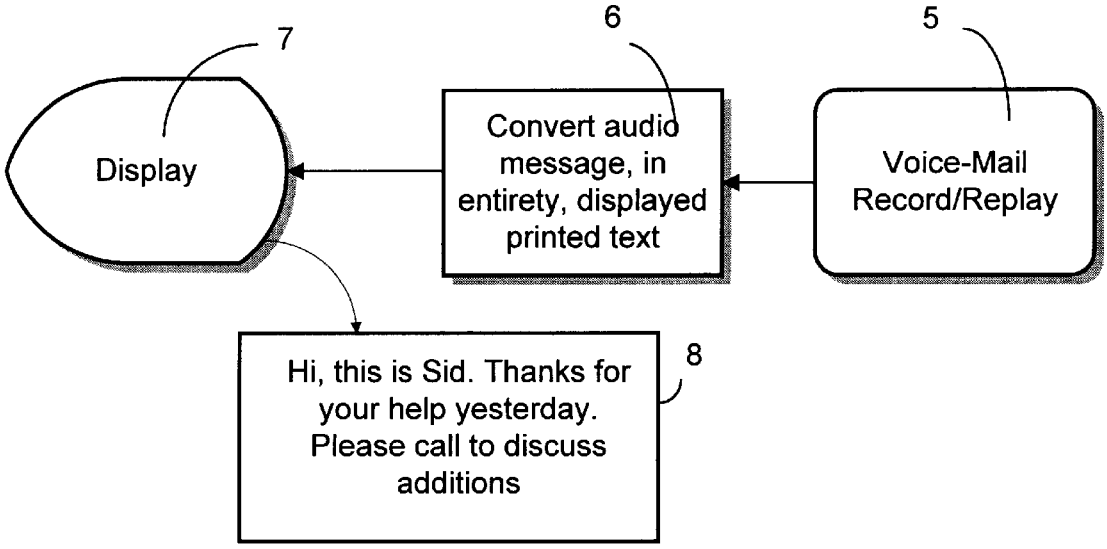
Figure 2 (Prior Art)
FIG. 2 is a block diagram of another prior art arrangement that uses speech recognition for converting signals representing audible voice-mail messages, in their entirety, into printed characters—e.g. ASCII characters and displayed to the intended recipient in a written form.

FIGS. 1 and 2 illustrate aspects of the relevant prior art known to us at this time.

FIG. 1 shows a voice-mail record/replay system 1, having a display 2 on which a chart of elapsed message playout time is shown, as suggested at 3. Signal generating means 4 produces signals which control the display form. The time chart shown at 3 consists of a moving line indicator which originates at a starting ("0%") point and darkens progressively as playout time of an audio message elapses. Obviously, other chart forms could be used with similar effect; e.g. a circular pie chart containing a radial sector darkening progressively, etc.

FIG. 2 shows an electronic mail system 5, which receives and stores voice messages, but uses voice recognition apparatus suggested at 6 to convert each message in its entirety to signals displayable in a printed/written form (e.g. signals representing ASCII characters) and displays the message in that form on display apparatus 7, as exemplified at 8. Those skilled in the relevant arts should recognize immediately that the apparatus at 6 is very complex and costly, and would be very difficult to operate in a "speaker-independent" manner; i.e. in a manner unaffected by inflections, dialects, voice volume and other attributes of different "callers" leaving their messages on the system.

2. Preferred Embodiment

Figure 3:
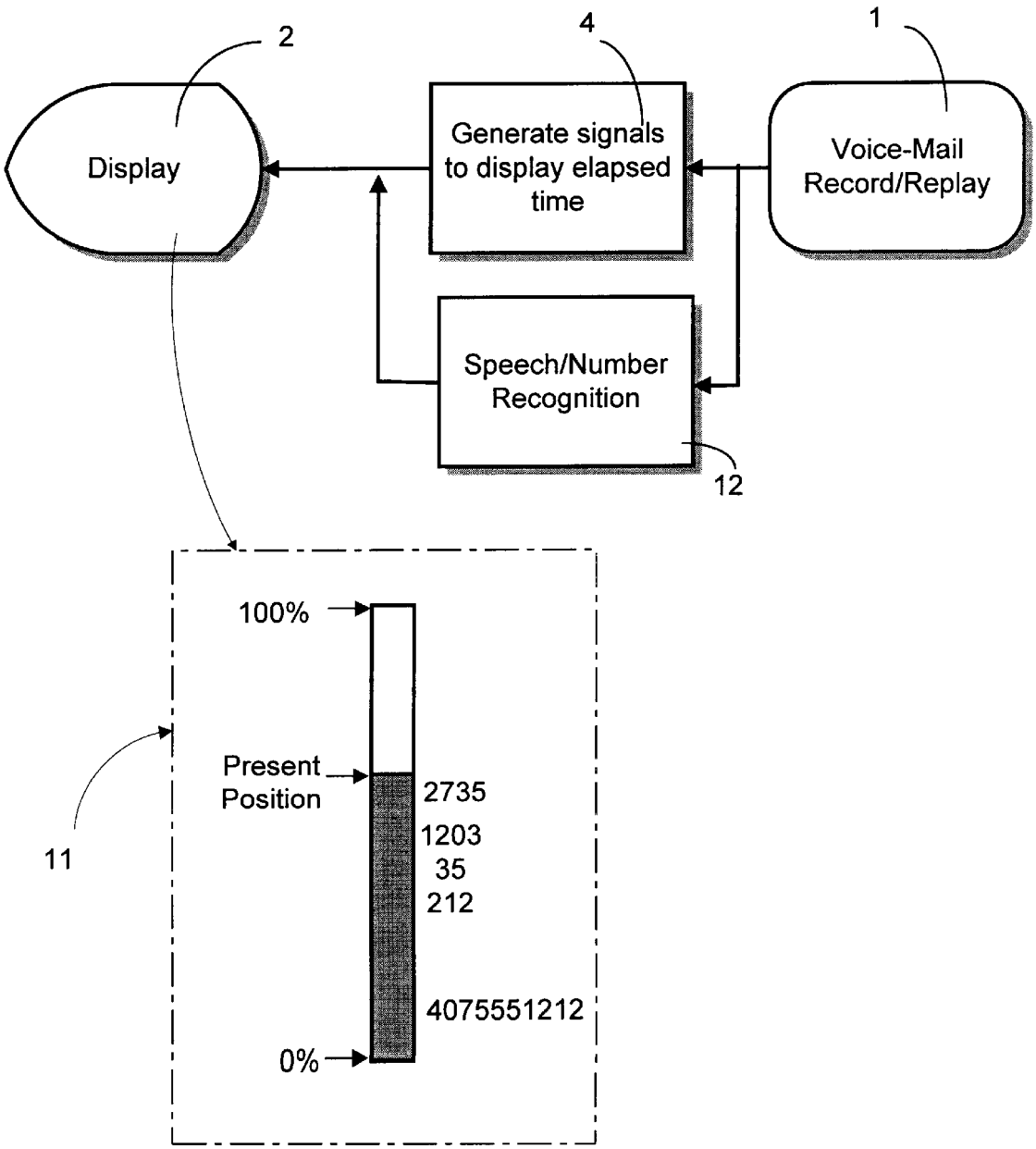
FIG. 3 shows an arrangement in accordance with the present invention for displaying both a scale of elapsed playout time of a voice-mail message, together with symbols representing certain spoken words or phrases detected during the playout, where the words or phrases symbolized are elements of a small but significant vocabulary of words and/or phrases ("small", as used here, meaning very small in comparison to the total number of words or phrases contained in the language in which the message is spoken).

FIGS. 3–7 illustrate the organization and operation of a preferred embodiment of the present invention. In FIG. 3, parts functionally identical to parts shown in FIG. 1 are identified by numbers identical to those respectively given in FIG. 1. Thus, FIG. 3 shows a voice-mail system 1, for recording and selectively replaying voice messages in audio form, display apparatus 2, and means 4 producing signals causing the display 2 to show a chart 11 of elapsed playout time.

However, in addition, this system contains voice-recognition means 12 for recognizing a limited vocabulary of words; in the illustrated system words denoting numbers. Voice-recognition means 12 preferably operates in a speaker-independent manner; i.e. to recognize desired expressions regardless of differences (in inflection, accent, tone, etc.) between different speakers. However, it should be understood that use of voice-recognition means operating in a speaker-dependent manner would also be within the scope of our invention.

Furthermore, means 12 operates in time coordination with (elapsed time) chart generating means 4 to generate signals for displaying printed counterparts of spoken numbers detected by means 12 at time positions along the chart (of elapsed playout time) corresponding to instants of time at which speech functions representing respective numbers are detected. Also, when a series of numbers are spoken consecutively, means 12 displays a respective set of printed numerals representing the entire series.

Thus, as shown in FIG. 3, at a location closest to the origin (0%) point of time chart 11, the printed number "4075551212" represents a series of ten numbers spoken consecutively in a message; and a second set of printed numerals "212", further from the origin position, represents a series of three consecutively spoken numbers in the same message, etc.

Although it is not apparent from simple inspection, the first set of numbers could be a telephone number including an area code and the second set could for instance be part of a street address, etc. In general, however, some numbers used in speech could be virtually meaningless when considered out of context. Consider, for instance, the well known use of area codes and 7-letter "names" (e.g. "1-800 CALL MOM") where the 7-letter name is formed from the letters associated with individual tone keys on conventional handsets.

Accordingly, it is understood that there are potentially many instances in which sets of numbers considered only as numbers, and apart from any other speech context, could be meaningless when so considered. However, since a user of the present invention would have a number of replay operations described later (reference description of FIG. 7B to follow), the significance of each set of printed numbers could readily be grasped through a review of the speech context associated with the audio part of a message from which each set is extracted; e.g. such significance might be grasped either by pausing message playout just as the respective printed set of numbers appears on the display, or by later replaying a portion of the message centered around the time of appearance of the respective set on the display.

Apart from its use in the just-described manner, speech-recognition means 12 is implementable by commercially-available software-based products geared to performance of specialized speech-recognition functions. Those skilled in the art, and those who have encountered recorded announcements instructing them to begin speaking certain information at a tone (e.g. their name and address), will recognize that such products are generally state-of-the-art today.

An example of one type of product capable of such operation is one known as "BBN Hark Telephony Recognizer". According to its product literature, this "is a robust, speaker-independent continuous speech recognition software product supporting active vocabularies from 2 to 2,000+ words", and is illustrated as having capability for displaying detected speech in printed form. Clearly, a product of that type could be adapted to recognize series of spoken digits/numbers, and produce displayable printed indications like those presently contemplated.

3. Use/Implementation of Preferred Embodiment In Computer Networks

Figure 4:
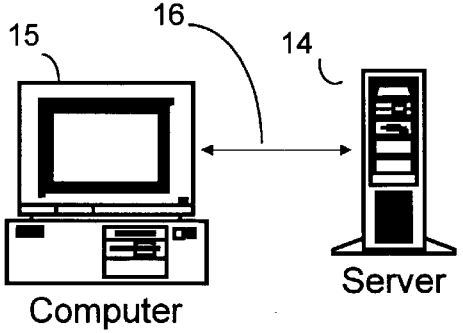
FIG. 4 schematically illustrates a network environment in which the invention could be used efficiently.

FIGS. 4–7 illustrate use of the embodiment just described in a computer network environment exemplified in FIG. 4. In that environment, a data processing system 14, termed a server, stores massive amounts of information, and provides services related to that information to multiple "client" computers (e.g. personal computers), one of which is shown at 15. A communication link suggested at 16 connects the client computers with the server. For present purposes, the client computers such as 15 are assumed to be "multimedia" type systems having capabilities for playing audio messages as well as displaying printed matter.

Figure 5:
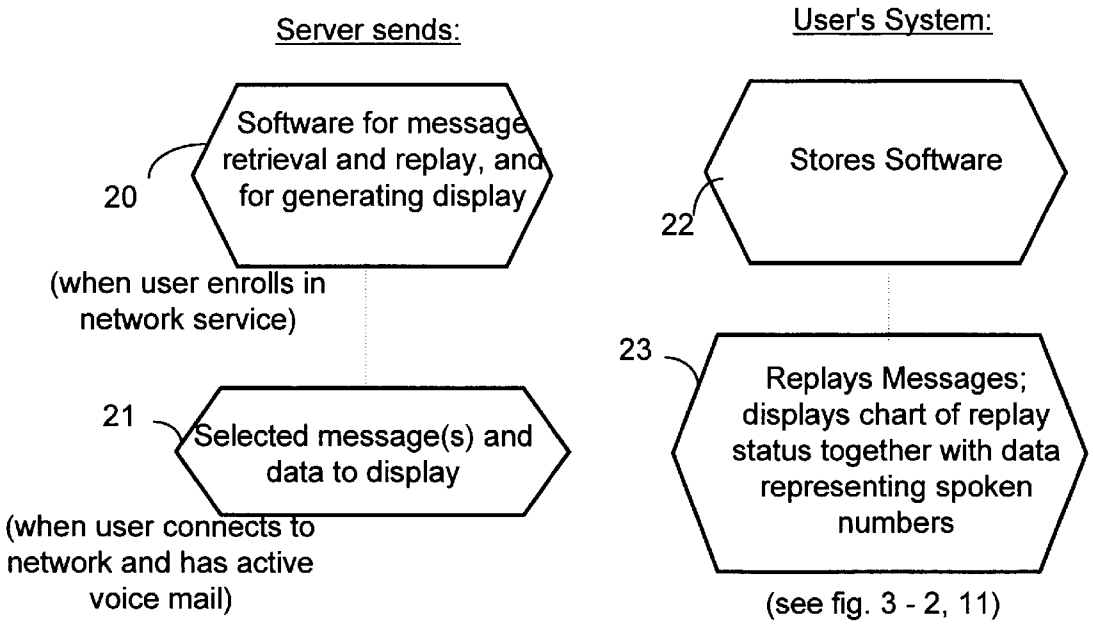
FIG. 5 is a high level flow diagram showing activities performed by a network server and remote personal computers in the network environment of FIG. 4.

FIG. 5 provides a general indication of communication functions that are respectively performed by the server and client computers in handling of voice-mail messages in accordance with the present invention.

When the owner of a client computer subscribes to the service provided by the server, that owner/user is assigned a "mailbox" at which the server stores audio messages directed to the user. As suggested at 20, the user is then provided with software, sent e.g. over the link 16, for performing message retrieval and replay functions. As suggested at 21, these functions, for example, may include: selecting a message currently stored at the server to be downloaded to the user's computer; having such downloaded message played out in audio form; and concurrently having a composite chart of elapsed playout time and printed numbers displayed, as the playout progresses, as exemplified at 11 in FIG. 3.

As suggested at 22, the software received from the server is stored permanently in the client computer; i.e. it is not repeatedly transmitted for each message retrieval session. As shown at 23, during subsequent communications sessions between the client computer and server, messages currently stored in the user's mailbox are played out in the client computer and the composite display described previously is formed as the message is played out.

Figure 6:
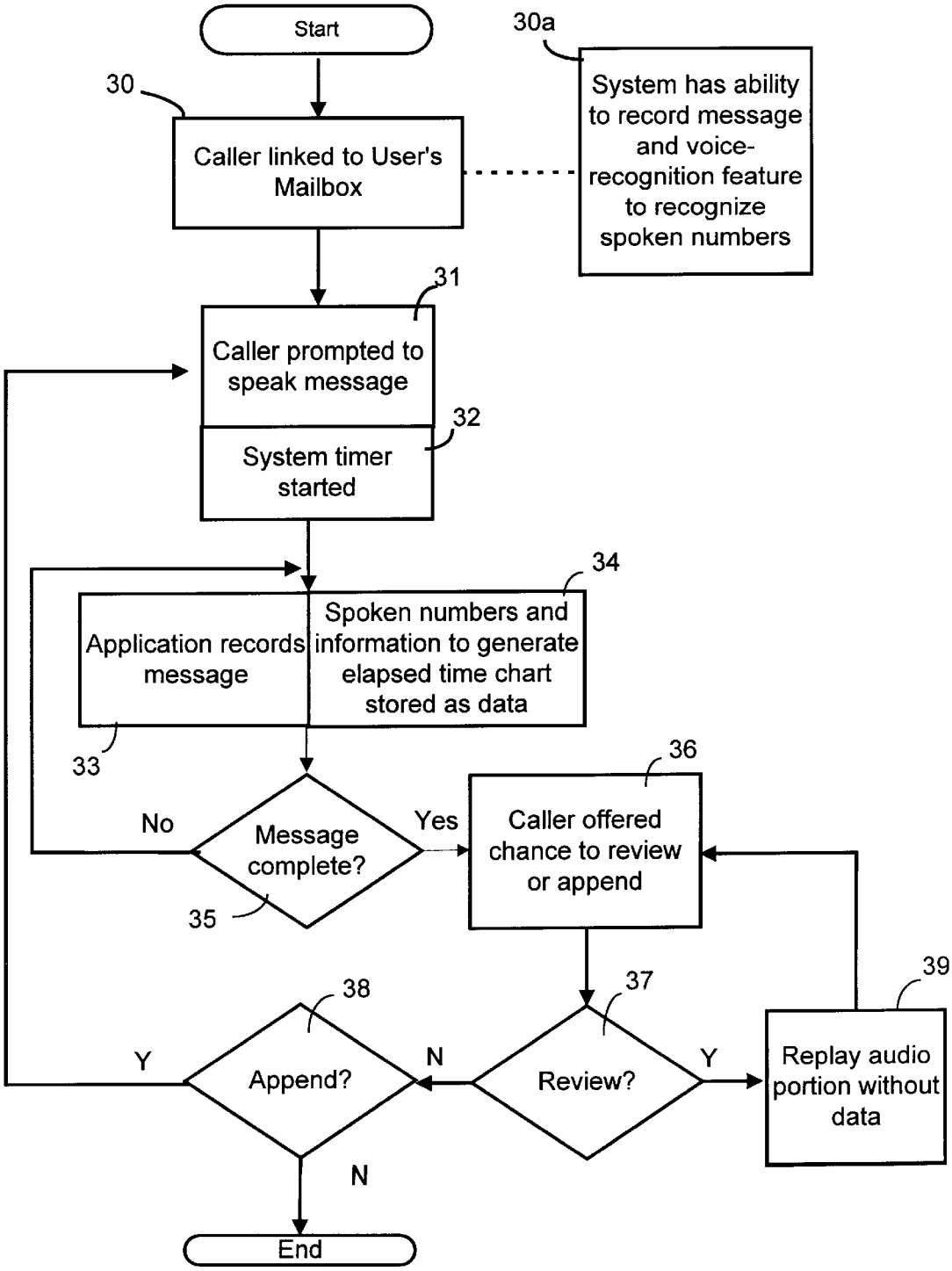
FIG. 6 is a flow diagram of operations conducted in accordance with this invention for recording a voice-mail message at the server center of the network environment of FIG. 4.
Figures 7, 7A, 7B:
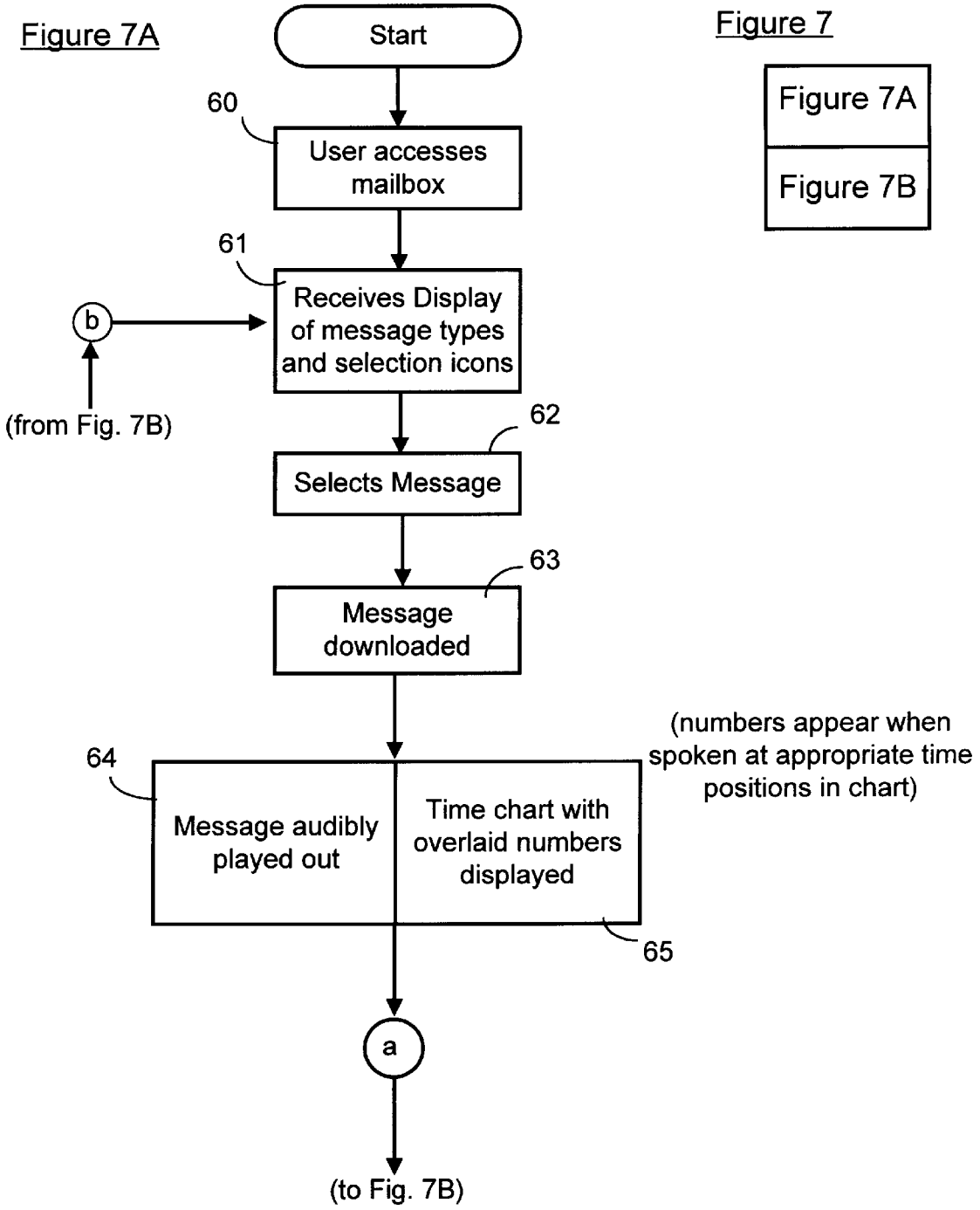
FIGS. 7A and 7B, viewed as shown in FIG. 7, constitute a flow diagram of how messages are retrieved and handled at individual computers in the network environment of FIG. 4.
Figure 7B:
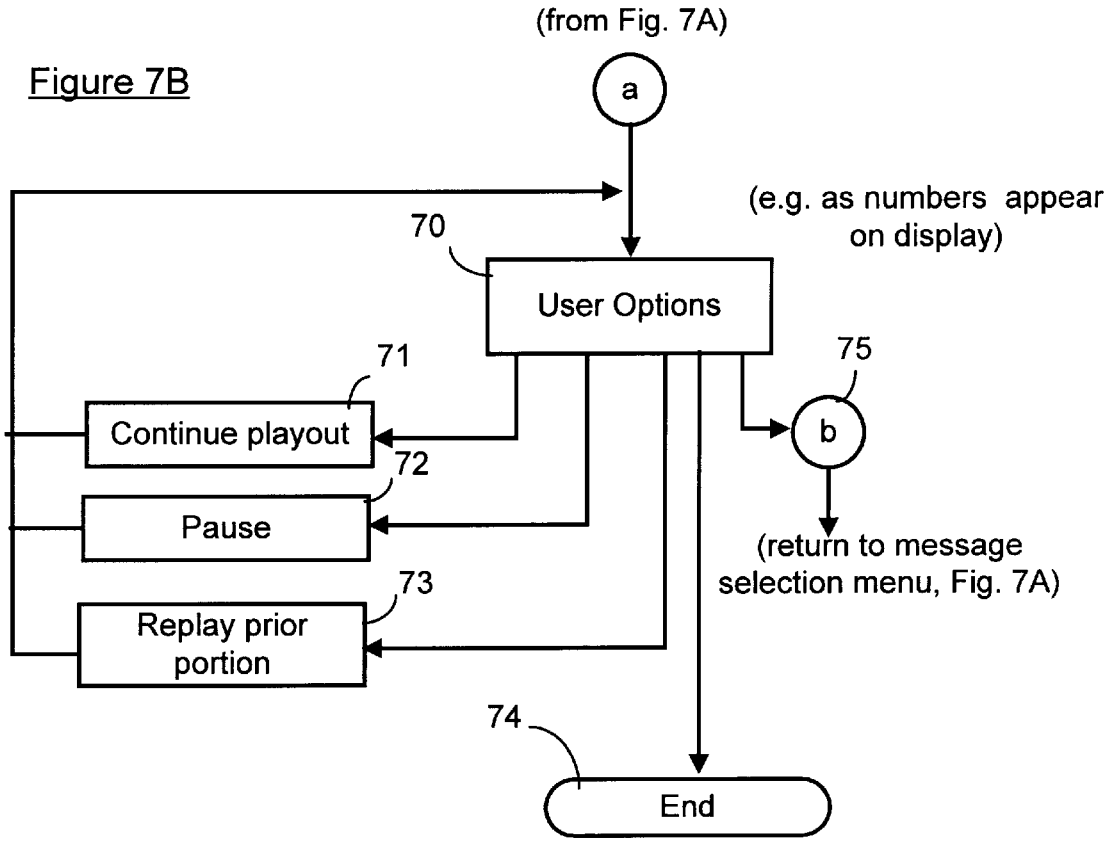

Not shown in this figure (FIG. 5), but explained with reference to FIGS. 6, 7A and 7B, is where and how the spoken number speech-recognition function is performed.

FIG. 6 shows operations performed at the server for receiving incoming calls, and recording audio messages along with information of the type presently required for display purposes.

As seen at 30, a caller is initially linked to the mailbox of a user associated with the called destination (or address, or number, etc.), and, as noted at 30*a*, the computer system at the server has the abilities to record voice messages and to perform speech/recognition functions of the type needed to generate the subject composite display of elapsed time overlaid with printed numbers corresponding to spoken ones.

At 31, the caller is prompted to speak a message, and at 32, when the cue for the caller to begin speaking is given (e.g. a "tone"), a timer is started. At 33, the caller's spoken message is recorded while at the same time, as indicated at 34, information is recorded for generating a composite display (elapsed time chart overlaid with printed numbers corresponding to the spoken numbers) of the type shown at 11 in FIG. 3. It should be appreciated that the operation at 34 involves several functions; including detection of spoken numbers (by speech recognition software), and extraction from the timer started at 32 of signals for defining at least the origin of the elapsed time chart and times of detection of spoken numbers relative to that origin. They also would involve storage of displayable print, symbols corresponding to detected numbers, in association with information defining time positions relative to the time chart for displaying respective symbols.

At 35, the recording system determines if the message has concluded (e.g. by timing out a defined period of silence after the last spoken number). If the message has not concluded, operations 33 and 34 (recording and time/number extraction) continue; otherwise, the caller is given options to review and/or add to the recorded message (operation 36, which e.g. could be a recorded announcement given to the caller). Decision 37 indicates what occurs in respect to the caller's option to review the message thus far recorded, and decision 38 indicates what occurs in respect to the caller's option to add to that message.

If, at 37, the caller chooses not to review the process advances to decision 38; otherwise, the process branches to operation 39 at which the message is replayed for the caller's review, and then repeats the sequence starting at 36. If the caller chooses not to add to the recorded message, at decision 38, the operation is ended, whereas if the caller opts to add to the message operations 33–39 are repeated.

Those skilled in the art will appreciate that operations 35–39 are exemplary, and that many other actions could be taken at this stage in the recording process and many other options could be offered to the caller at the same stage.

FIGS. 7A and 7B, arranged in the orientation shown in FIG. 7, constitute a flowchart of operations performed at a client computer for retrieving and replaying messages currently stored at the server in the respective client's/user's mailbox. FIG. 7A shows operations performed for retrieving and replaying a message, as well as for generating the composite time/number display shown in FIG. 3. FIG. 7B shows, as exemplary, options that may be offered to the user/client and actions that would be taken in respect to such.

When a client computer establishes communication with the server, and is thereby given access to the respective user's mailbox (action 60, FIG. 7A), the application software (which was downloaded to that computer e.g. at sign-on time; refer to operation 20, FIG. 5) causes the client computer to cooperate with the server to display to the respective user the types of unretrieved messages currently stored in the client's mailbox, along with icons or other menu elements for enabling the user to select a message to retrieve (operation 61, FIG. 7A). Upon selection of a message (action 62, FIG. 7A), the message and data representing spoken numbers (refer to action 34, FIG. 6) are downloaded to the client computer and stored there at least temporarily (action 63, FIG. 7A). The message is audibly replayed at the client computer as it is downloaded (action 64, FIG. 7A).

As the message is replayed, a composite chart of the type shown in FIG. 3 (elapsed playout time overlaid with symbols representing numbers spoken in the message) is displayed on the client computer (action 65, FIG. 7A). As indicated in parentheses adjacent to action block 65, the displayed number symbols appear on the chart just as corresponding numbers are spoken, and are located at positions corresponding to instants of time at which respective numbers are spoken. The displayed symbols are, of course, derived from the data downloaded from the server with the message.

As suggested at 70 in FIG. 7B, as each set of numbers appears on the display, the user is given opportunity to selectively exercise options. Exemplary options—suggested at 71–75 in FIG. 7B—are to continue playout (option 71), pause playout momentarily (option 72), replay a portion of the message associated with a set of displayed numbers (option 73), discontinue message handling completely (option 74), or discontinue playout of the current message and return to the original selection menu presented at 61 in FIG. 7A (option 75 and linkages symbolized by encircled "b's" in FIGS. 7A and 7B).

4. Alternative Network Actions

Those skilled in the art should understand that the foregoing network operations could be varied without significantly changing the display effects presented at the client computer.

For example, messages could be recorded at the server without time monitoring or speech recognition, and these functions could be performed at the client computer. However, the increased amount of software at client computers that this would necessitate might not be feasible either economically or in terms of network bandwidth usage. Thus, it should be appreciated that performing the time monitoring and speech/number recognition functions at the server is probably the most efficient way to accomplish these tasks.

Also, it should be appreciated that software could be distributed to client computers off-line to the network; e.g. as a program product on disk storage media.

Also, it should be understood that software is transmitted via the network needn't be sent when a client signs up for network service. It could, for instance, be sent during each access to the service, depending upon economic considerations and available network bandwidth.

5. Alternative Composite Display

Figure 8:
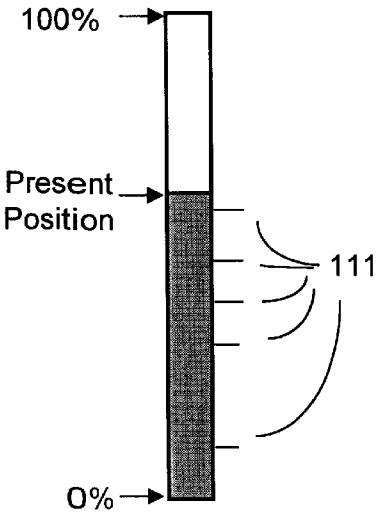
FIG. 8 schematically illustrates a simplified alternative to the composite time scale and symbol display shown in FIG. 3.

Another possibility, suggested at 111 in FIG. 8, is to change the composite display to a simpler form; e.g. to replace displayed sets of numbers with single linear marks perpendicular to the chart. Such marks would alert the client/user to utterances of numbers in the message without detailing the numbers per se. This type of display might be used to provide functionally similar but cheaper services to homes which do not have computers; e.g. in a special purpose stand-alone device used only for telephone answering.

Other alternatives should be readily apparent to those skilled in the art of telephone based communications. Accordingly,

We claim:

1. An accessory for a sound recording and playback system comprising:

a visible display;

speech recording means coupled to said system for sequentially recording spoken messages to be audibly reproduced by said system, each recording produced by said recording means having a discrete starting point:

means interfacing between said system, said recording means, and said display for generating a chart of playback time on said display, said chart indicating time elapsed relative to said starting point during audible reproduction of a recording stored by said recording means;

speaker-independent speech recognition means coupled to said system for detecting occurrences of predetermined audible expressions during audible reproduction of a recording stored by said recording means; said predetermined expressions constituting components of a limited vocabulary of N different expressions; where N is a number greater than 2 but substantially less than the number of different expressions recordable by said recording means; and means interfacing between said speech recognition means and said display for superimposing symbols on said time chart, said symbols representing respective said predetermined expressions detected by said speech recognition means and indicating times of occurrences of respective said expressions by their positions on said chart relative to an indication of the said starting point of a respective recording.

2. The accessory of claim 1 comprising:

means enabling a user of said system to use said time chart and said superimposed symbols to control audible replay of selected portions of a recording containing individual expressions indicated by said superimposed symbols in a manner enabling said user to review only said replayed portions without having to listen to the entire recording containing said portions.

3. The accessory of claim 2 wherein said system is a voice-mail retrieval and playback system, said audible reproduction of a said recording is effective to audibly reproduce multiple messages sequentially stored by said recording means, and said predetermined expressions detectable by said speech recognition means include words constituting elements of a spoken language.

4. The accessory of claim 3 wherein each said predetermined expression represents a spoken number, and wherein said means enabling said user to control said playback operation includes means enabling said user to interject a pause temporarily into said playback operation in order for the user to understand the context in which a respective number is spoken.

5. The accessory of claim 3 wherein each said predetermined expression represents a spoken number, and wherein said means enabling said user to control replay includes means enabling said user to control replay of a respective portion of a message containing a respectively spoken number, and thereby enable said user to understand the context of the respectively spoken number within the message containing said respective portion.

6. A computer program product on a computer readable medium for voice mail applications, said program product being transportable to and installable on computers and comprising:

instruction means for enabling a computer on which said program product is installed to receive and audibly replay a voice-mail message; and instruction means, executable in timed coordination with replay of said message, for causing said computer on which said product is installed to visibly display a chart, said chart representing the elapsed playout time of the message, and indicating times of occurrence of predetermined audible expressions during said playout time.

7. A computer program product in accordance with claim 6 wherein said predetermined audible expressions correspond to words contained in a predetermined spoken language.

8. A computer program product in accordance with claim 7 wherein said corresponding words are numbers subject to contextual interpretation by having small portions of respective messages replayed.

9. A voice-mail system for a computer network having a server processing center for receiving and recording audible voice-mail messages, and client computers linked to said server processing center, said client computers having facilities for receiving and audibly replaying selected ones of the messages recorded at said server processing center; said voice-mail system comprising:

time monitoring means at said server processing center operative to continually monitor time elapsed during recording of each voice-mail message received at said server processing center;

speech-recognition means at said server processing center, operative in time coordination with said means to monitor elapsed time, for recognizing when words in a predetermined vocabulary of words are spoken during the recording of each said message; the number of words contained in said predetermined vocabulary of words being small in relation to the number of words comprising the language in which said messages are spoken;

data recording means at said server processing center for recording data representing printable symbols corresponding to words detected by said speech-recognition means, along with time information associating said symbols with times at which respective words are spoken during recording of messages containing said words;

means at each said client computer for receiving a selected message recorded at said server processing center, together with the printable symbol data and time associating information recorded with the selected message;

means at each said client computer for audibly reproducing said selected message; and display means at each said client computer responsive to said printable symbol data and time associating information for producing a composite visible display containing time indications overlaid with printable symbols; said composite display comprising a varying chart of time elapsed as said selected message is audibly reproduced and printed symbols corresponding to words in said selected message that were detected by said server speech-recognition means; said printed symbols being positioned in relation to said chart of elapsed time to enable a user of the respective client computer to easily locate and audibly reproduce a portion of said selected message containing spoken words corresponding to the respective symbols.

10. A voice-mail system in accordance with claim 9 wherein said predetermined vocabulary of words consists exclusively of words representing numbers.

11. A voice-mail system in accordance with claim 10 wherein said printable symbols consist of printed numbers corresponding to individual number words detected by said server speech-recognition means.

12. A voice-mail system in accordance with claim 10 wherein said printable symbols consist of simple marks superimposed on said time chart; said marks having no numerical significance per se but indicating times at which respective number words are spoken during audible replay of a said message.

13. A voice-mail device comprising:

means for storing a voice-mail message;

means for audibly replaying a voice-mail message stored by said storing means;

display means;

means coupled to display means and said replaying means for causing said display means to display a chart progressively indicating time elapsed during audible replay of a message stored by said storing means;

speech recognition means responsive to a voice-mail message applied to said storing means for detecting when said message contains certain predetermined words;

means coupled to said speech recognition means for storing data representing words detected by said speech recognition means; and means responsive to said stored data representing said detected words for causing said display means to display indications of respective data in time coordination with audible replay of parts of a said message consisting of words represented by respective data.

14. A voice-mail device in accordance with claim 13 wherein said words detected by said speech-recognition means consist exclusively of numbers.

15. A voice-mail device in accordance with claim 14 wherein said displayed indications of said respective data comprise symbols representing numbers.

16. A voice-mail device in accordance with claim 14 wherein said displayed indications of data comprise marks superimposed on said time-chart display; said marks having no numerical significance per se but indicating by their displayed presence times during audible message replay at which numbers are being spoken.

* * * * *